United States Patent [19]

Heischober et al.

[11] Patent Number: 4,995,290

[45] Date of Patent: Feb. 26, 1991

[54] APPARATUS AND METHOD FOR CONTROLLING A PNEUMATICALLY POWERED MUSIC-MAKER

[75] Inventors: Norman Heischober, Massapequa; Paul Keogler, Valley Stream, both of N.Y.

[73] Assignee: H. & K. Automated Musical Creations Co., Massapequa Park, N.Y.

[21] Appl. No.: 362,615

[22] Filed: Jun. 7, 1989

[51] Int. Cl.[5] ..... G10F 5/04

[52] U.S. Cl. ..... 84/160

[58] Field of Search ..... 84/115, 151, 147, 160

[56] References Cited

U.S. PATENT DOCUMENTS 1,009,268 11/1911 Trist ..... 84/147 X

*Primary Examiner*—Brian W. Brown

*Attorney, Agent, or Firm*—Collard, Roe & Galgano

[57] ABSTRACT

An appartus for controlling a mechanical music-maker, such as a player-piano has a multiplicity of mechanical actuators and uses a vacuum as the motive force therefor. The mechanical actuators, which actuate corresponding musical keys, are each controlled by a valve which connects the vacuum to the mechanical actuator when opened. The valve is opened when the vacuum side thereof is vented to atomsphere by the first venting system. A second venting system is provided, which can be isolated from the first venting system. The second venting system utilizes electrically energizable solenoid valves to control the venting of the vacuum side of each valve when the first venting system is isolated therefrom.

7 Claims, 3 Drawing Sheets

APPARATUS AND METHOD FOR CONTROLLING A PNEUMATICALLY POWERED MUSIC-MAKER

BACKGROUND OF THE INVENTION

1. Field of the Invention

This invention relates to an apparatus for controlling mechanical music-makers, such as player-pianos, nickelodeons, and reed organs, which utilize a vacuum as the motive force for pneumatically driving mechanical key actuators therein. More particularly, the invention relates to a valve system which can isolate the standard vacuum actuation system found in these mechanical music-makers and allow the utilization of an electrically controlled actuation system, which system may be controlled by a programmable microprocessor-based control apparatus.

2. Description of the Prior Art

Player-pianos, nickelodeons and reed organs are well-known and were popular in the early part of the Twentieth Century. These player-pianos utilized a vacuum system to control the mechanical actuation of the keys. In most player-pianos, for example, the vacuum is created by pedaling a suction bellows with the feet, which suction bellows is located in the lower portion of the piano. The vacuum produced was channeled through a manifold system into the upper area of the piano, where it was utilized to control individual valves of a pneumatic actuation system. The actuation system, itself, consisted of a multiplicity of small bellows, each having a push rod attached thereto. Each push rod operated a piano key when activated by a sudden collapse of the bellows as a result of an individual vacuum control valve opening and connecting the inside of the bellows to a vacuum, thereby allowing the air inside to escape.

These pneumatic valves were generally controlled by a tracker bar having a multiplicity of holes therein corresponding to each key of the piano. A player-piano paper roll having a plurality of perforations corresponding to a musical piece was then rotated across the tracker bar. When a hole on the player-piano roll overlies a hole in the tracker bar, the vacuum holding the pneumatic valve closed is vented via a tube which runs from the tracker bar to a vacuum side of the valve. The valve then opens allowing the vacuum manifold to be directly connected to the bellows thereby actuating the piano key and playing the corresponding note by striking the piano string with the hammer in the standard manner.

With the advent of electronically controlled pianos and music synthesizers, electronic devices have been developed which can produce or utilize a standardized MIDI output signal. These standardized signals can be pre-recorded on hard or soft floppy disks, or via preprogrammed MIDI hybrid chips or pre-recorded MIDI tape cassettes, which can act as an input for the production of the sounds of these electronic pianos and synthesizers. However, until the present invention, there has been no method by which a standard player-piano or nickelodeon could be controlled by a pre-recorded MIDI electronic signal. This is because, as described above, the control system for a player-piano or nickelodeon is exclusively mechanical and controlled exclusively by a pneumatic control system.

SUMMARY OF THE INVENTION

It is an object of the invention to provide a valving system which is capable of utilizing an electrical signal to control the standard pneumatic operation of a mechanical music-maker of the type using a vacuum as a motive force.

It is yet another object of the invention to provide a valve system which can isolate the tracker bar control system of a player-piano from the valves controlling the pneumatic bellows therein and simultaneously allow the solenoid actuation of each of the valves.

It is still another object of the invention to provide an apparatus for controlling a mechanical music-maker which selectively allows the utilization of an electrical control signal to play the pneumatic actuation system on a music-maker, which apparatus is simple in design, economical to manufacture, and which can be located in any convenient place on the music-maker.

Accordingly, these and related objects are achieved by an apparatus for controlling a mechanical music-maker which is of the type using a vacuum as a motive force for driving a multiplicity of mechanical actuators for actuating corresponding musical keys. The music-maker includes a multiplicity of valves, each corresponding to a key on the music-maker, for connecting the vacuum to the multiplicity of mechanical actuators when the valve is opened. The valves are held closed by a vacuum applied to a vacuum side thereof and open upon having the vacuum side vented to atmosphere. A first venting system is provided for selectively coupling the vacuum side of each valve to the atmosphere. A second system, which is electrically controlled, is provided for selectively coupling the vacuum side of each valve to the atmosphere. A selector is included for selectively isolating the first venting system from the valve, so that opening the valve by selectively coupling the vacuum side thereof to the atmosphere can be accomplished solely by the second venting system.

The first venting system generally includes a tracker bar having a registry member with a series of passages for registering with holes in a paper-piano roll. Each of the passages in the tracker bar may be connected to the vacuum side of each of the valves by the selector. The vacuum side of each valve is then vented to atmosphere when a hole in the player-piano paper roll registers with that passage in the tracker bar.

The selector comprises a valve body having a multiplicity of passageways therein. Each passageway corresponds to a musical key on the mechanical music-maker. Each passageway has an outlet side coupled to the vacuum side of each valve, and an inlet side coupled to the first venting system. The selector has an isolation valve for isolating the inlet side and, therefore, the first means from the outlet side of the valve body. A vent extends from each of the multiplicity of passageways to the atmosphere between the isolation valve and an outlet of the outlet side of the valve body. A solenoid valve is provided for sealing each vent when de-energized and for opening each vent to atmosphere when energized.

The isolation valve includes a multiplicity of depressions formed on a surface of the valve body, intermediate the inlet and outlet of each passageway. Each depression is covered by a resilient, air-tight cover and includes a first centrally located opening connected to the outlet side of the passageway and a second opening, located at the perimeter of the depression, connected to the inlet side of the passageway. Thus, upon application of a vacuum to the outlet side of the passageway, the resilient covering is sucked downwardly into the depression and covers and, therefore, seals the central opening to isolate the outlet side of the passageway from the inlet side and, therefore, the first venting system. A vacuum chamber is formed above and surrounds, the multiplicity of depressions for pulling the resilient covering away from the central opening, upon creation of a differential pressure between the chamber and the outlet side of the passageway.

These and other objects and advantages of the present invention will become apparent from the following description of the accompanying drawings, which disclose one embodiment of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
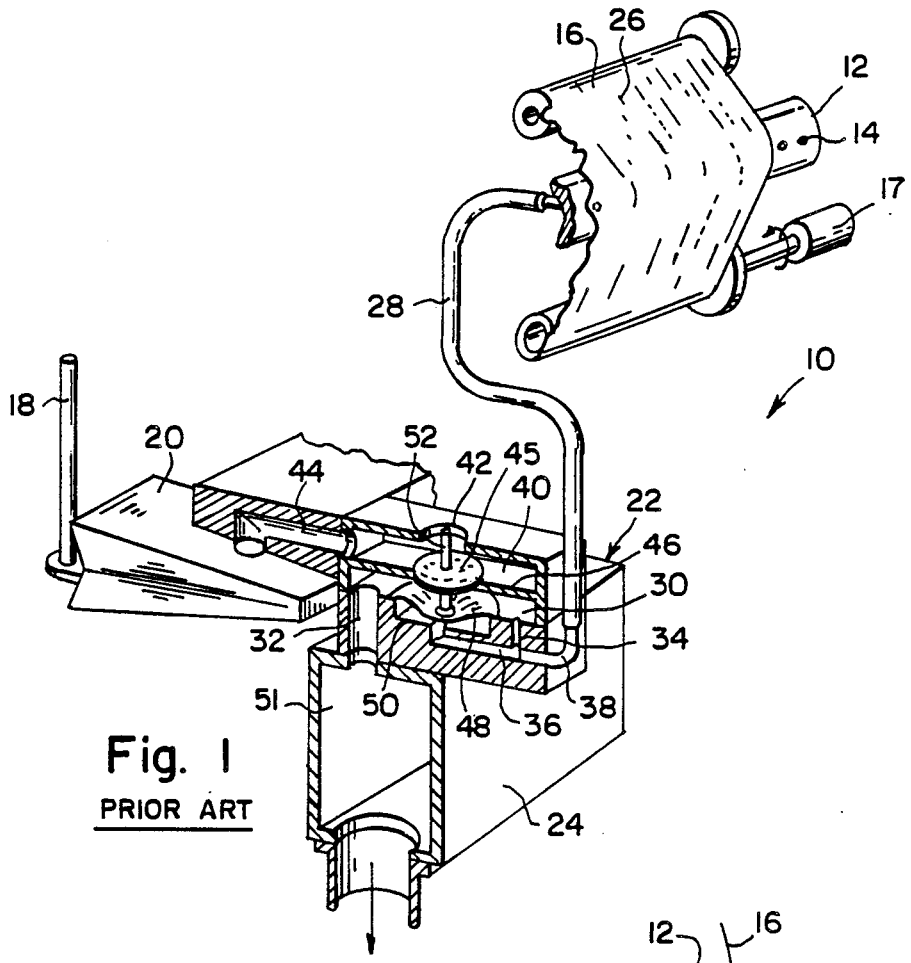
Fig. 1 PRIOR ART
FIG. 1 is a perspective view, partially in cross-section, of a prior art single valve pneumatic system for controlling a mechanical music-maker.
Figure 2:
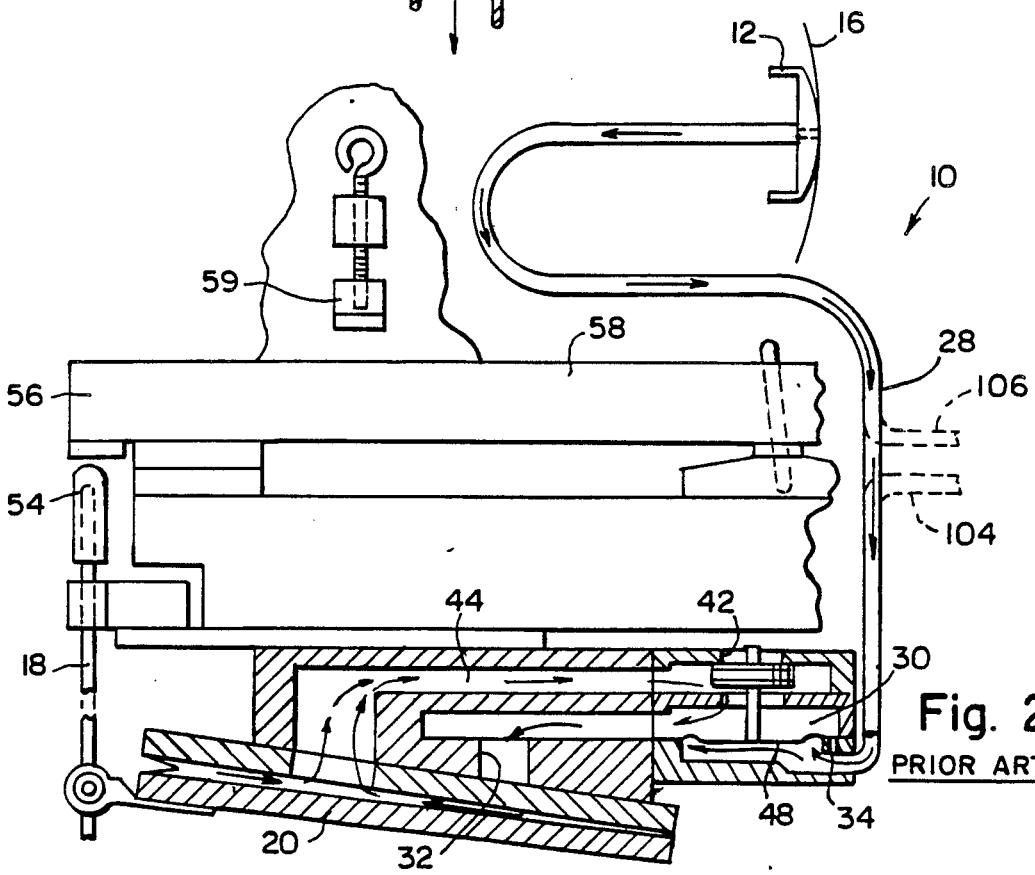
Fig. 2 PRIOR ART
FIG. 2 is an elevation view, partially in cross-section, of the prior art single valve pneumatic system of FIG. 1.

Referring to FIGS. 1 and 2, there is shown the prior art pneumatically controlled actuation system or pneumatic stack for a typical music-maker, such as a player-piano. A single actuation apparatus of the pneumatic stack, generally denoted as 10, is shown, wherein a tracker bar 12, having a plurality of holes 14, is used in combination with a paper roll 16 to control the actuation of the piano keys. Each key has a corresponding apparatus which controls the actuation thereof with each key being actuated by a push rod 18 connected to the typical piano action. Push rod 18 is actuated by an action pneumatic in the form of a collapsible bellows or pneumatic 20. Pneumatic 20 is normally filled with air at atmospheric pressure and can be selectively coupled to a vacuum by a pneumatic valve 22 with one valve 22 corresponding to each key. Typically, valves 22 are supported by and connected to an upper vacuum chest 24. Vacuum chest 24, in turn, is connected to a suction bellows (not shown) normally operated by foot pedals.

As is well-known, the typical paper roll for a player piano includes a series of holes 26 therein, which may be superimposed over holes 14 in tracker bar 12. Therefore, as roll 16 is rotated by an air motor 17 and traverses tracker bar 12, holes 14 therein are alternately covered or exposed to atmosphere. A pneumatic tube 28 communicates with each hole 14 and each valve 22, which tube normally contains a vacuum. This can be seen from FIG. 1, wherein upper vacuum chest 24 is connected to cavity 30 of valve 22 by passageway 32. A bleed 34 is formed within the body of valve 22 and communicates with a duct 36 therein, which in turn communicates with the outlet 38 of tube 28. Again, referring to FIG. 1, it can be seen that cavity 30 is normally under vacuum and, therefore, the interior of tube 28 via bleed 34 is also at a reduced pressure. Valve 22 also includes cavity 40, which is normally coupled to atmosphere via opening 42 and is also coupled to bellows 20 via duct 44. Because of the differential pressure between cavity 30 and cavity 40, a valve element 45 is held in sealing engagement with an opening in the wall 46 separating cavities 30 and 40.

The prior art valve 22 also includes a pouch or resilient cover element 48 sealing the top of a circular depression 50 formed therein. Valve element 45 has a rod 52 fixedly attached thereto engaging the top of resilient cover 48. Thus, when the particular hole 14 in tracker bar 12 is covered by the paper of roll 16, tube 28 is under vacuum, depression 50 is also under the influence of vacuum and, therefore, the resilient covering is downwardly deformed by the force on rod 52 produced by atmospheric pressure in chamber 40 operating on the top surface of valve element 45. It can be seen that as player-piano paper roll 16 rotates and the particular hole 14 is uncovered, tube 28 is vented and, therefore, the pressure in depression 50 is equalized with respect to the atmosphere, which causes, due to the resiliency of cover 48, valve 45 to be displaced upwardly sealing opening 42, which in turn causes duct 44 and action pneumatic 20 to vent.

Referring to FIG. 2, it can be seen that venting of the air through duct 36 causes action pneumatic 20 to collapse, thereby moving push rod 18 upwardly and causing striker 54 thereof to impact on the inside end 56 of piano key 58, thus causing the piano action to strike the corresponding piano string in the well-known manner.

Figure 3:
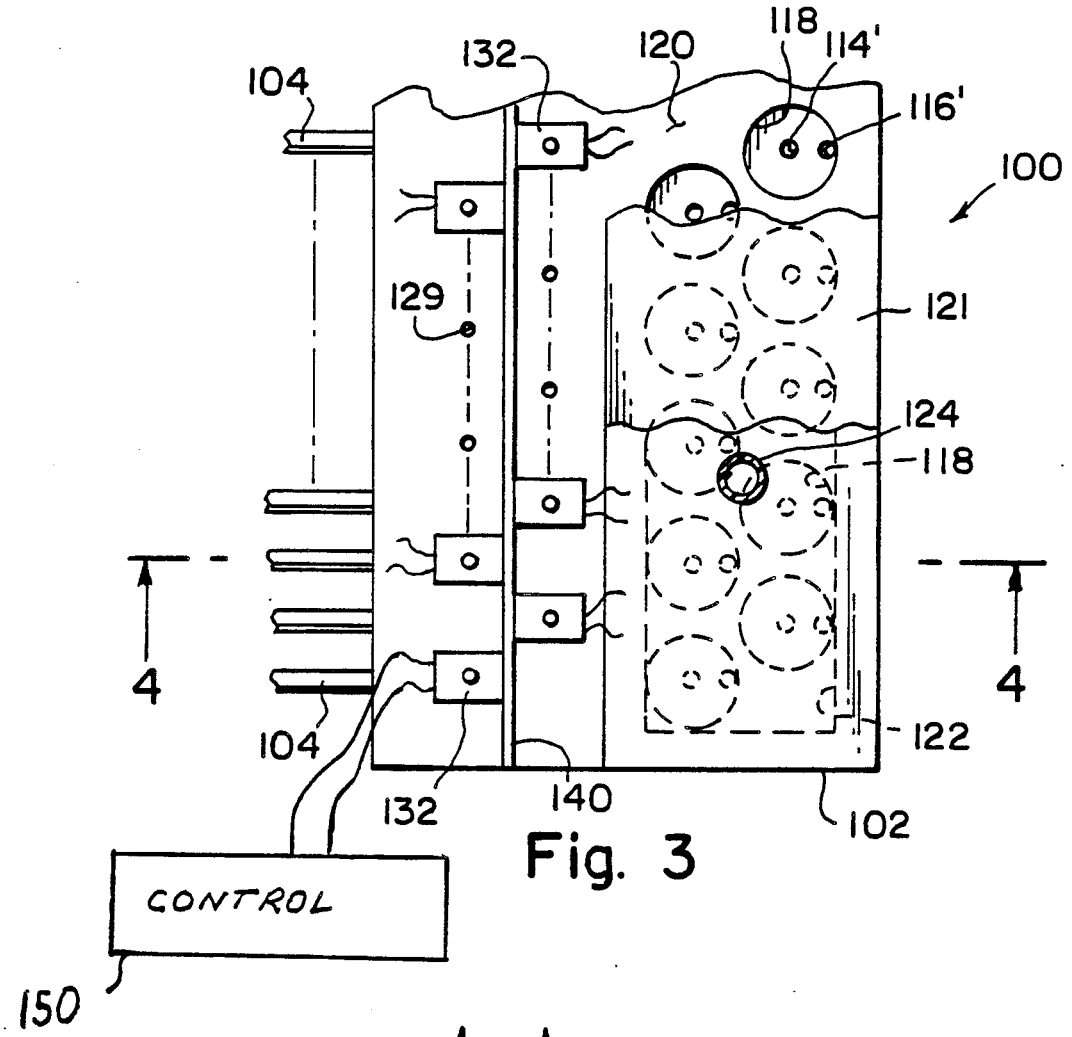
FIG. 3 is a top view of the control apparatus of the present invention.
Figure 4:
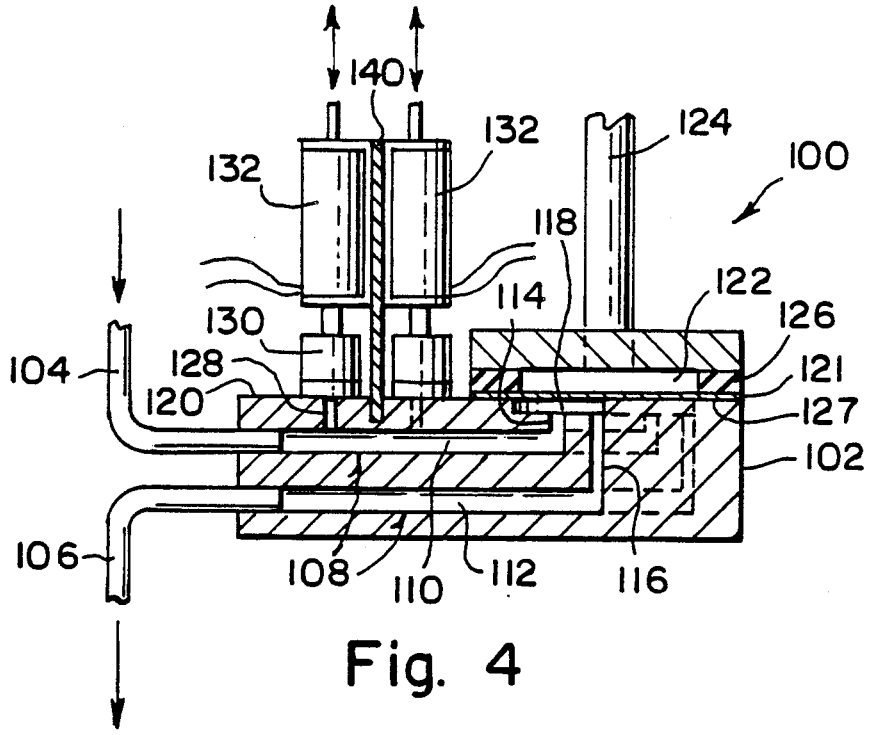
FIG. 4 is a cross-sectional view of the apparatus of FIG. 3 along line 4—4 thereof.
Figure 5:
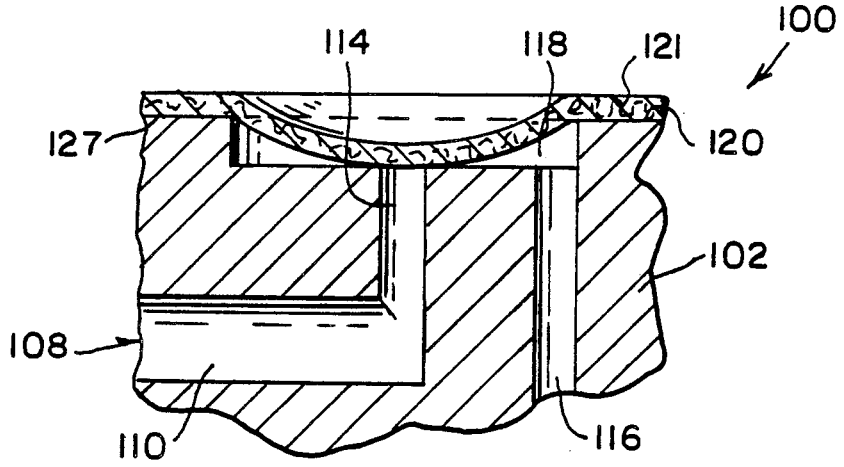
FIG. 5 is an enlarged cross-sectional view of the isolating device of FIG. 4.

Referring to FIGS. 3 through 5, there is shown the control apparatus of the present invention, generally denoted as 100, which is adapted to be placed in any convenient point inside a player-piano or other music-maker. Control apparatus 100 includes a body 102 which has a multiplicity of inlets 104 each connected to a passageway 36 of each valve 22 and a multiplicity of outlets 106 connectable via each tube 28 to holes 14 of tracker bar 12. Thus, as can be seen in phantom on FIG. 2, it is contemplated that tube 28 will be broken and inlet 104 attached to the lower portion thereof and outlet 106 attached to an upper portion thereof, which portions are shown in phantom in FIG. 2.

Corresponding to each inlet 104 and outlet 106, is a passageway 108, formed inside body 102, having an inlet side 110 and an outlet side 112. In the preferred embodiment, inlet side 110 and outlet side 112 are formed as parallel, vertically-spaced bores in body 102. At the inner ends of inlet and outlet sides 110, 112, respectively, are vertically-extending bores 114 and 116. Bores 114, 116 communicate with a generally cylindrical depression 118 formed in the top surface 120 of body 102. Bore 114 terminates in a hole 114' centrally located within depression 118, and bore 116 terminates in an opening 116', located at the periphery of each depression 118. A pouch or resilient cover 121 sealingly covers each depression 118. Resilient cover 121 may be made of a thin, pliable leather or any thin synthetic air-tight pliable material. A vacuum chamber 122 is formed above the multiplicity of depressions 118 and is connected to the suction system of the piano by duct 124. Vacuum chamber 122 includes a rubber gasket 126 around the periphery thereof to ensure an air-tight seal around vacuum chamber 122. To facilitate the action of resilient cover 121, it has been found advantageous to use a single sheet of the material extending the length and width of chamber 122, which sheet is clamped against top surface 120 by sealing elements 127.

Each inlet side 110 of passageway 108 includes a vent 128, which connects passageway 110 to atmosphere. Normally, vent 128 is in the form of a small diameter bore, having an opening or hole 129 in top surface 120. Opening 129 is covered by a resilient plunger portion 130 of a solenoid actuated valve 132. Solenoid actuated valve 132 is of the type that, when energized, lifts plunger 130 upwardly off of surface 120 and out of sealing engagement with vent hole 129. Since there is one solenoid 132 for every passageway 108 and, therefore, every hole 14 in tracker bar 12, there may be up to 88 passageways 108 in body 102 corresponding to the number of keys in a standard keyboard. Micropresser control 150 controls the selective actuation of all valves 132 (although the connection to only one valve 132 is shown in FIG. 3). Of course, either more or fewer passageways 108 can be included in control apparatus 100, depending on whether an instrument with more than 88 keys is being controlled or whether, as is normally the practice, less than all the 88 keys on a standard keyboard are controlled by the pneumatic system on a player piano (i.e., usually the keys at the extreme ends of the keyboard are not pneumatically controlled).

To help reduce the size of body 102 and, therefore, the space required inside the music-maker for its installation, solenoids 132 and depressions 118 are staggered so that passageways 108 may be spaced closer together. To facilitate mounting of solenoids 132, a mounting plate 140 is provided which serves to support solenoids on both sides thereof in an alternating manner. Likewise, depressions 118 are formed on surface 120 in a pair of offset rows so that the valve body 102 may be made shorter. Of course, alternate passageways 108 must be made longer in order to reach the rearward depression 118. In addition, vents 128 are placed on either side of wall 140, depending on the location of solenoids 132. Clearly, the valve body could be made longer so that solenoids 132 and depressions 118 are in line.

Turning now to the operation of the control apparatus of the present invention, a brief description of the standard player-piano operation will be provided for clarity. Again, referring to FIGS. 1 and 2, it can be seen that as piano roll 16 is rotated over tracker bar 12 by air motor 17, with upper vacuum chest 24 evacuated, tube 28 will then be evacuated, as long as the hole 14 corresponding thereto is covered. In this condition, valve 45 is held downwardly, tightly against the opening in wall 46 between chambers 30 and 40. In addition, resilient cover 48 is depressed by valve rod 52. Since valve element 45 blocks the flow of atmospheric air into cavity 34, bellows 20 remains at atmospheric pressure. When a hole in piano-player roll 16 coincides with the particular hole 14 for tube 28, the in-rush of air causes the pressure in chamber 50 to rapidly increase, which, when combined with the resiliency of cover 48, causes valve element 45 to lift, become unseated, and seal opening 42, thereby connecting the vacuum in upper vacuum chest 24 directly with bellows 20 causing it to collapse. Because the top surface of bellows 20 is fixed, the bottom surface is moved upwardly, causing push rod 18, in turn, to move upwardly and activate the piano action. Because bleed 34 is of a very small diameter, the vacuum in cavity 30 is not significantly reduced by the in-rush of air through tube 28.

Referring again to FIGS. 3 and 4, in order to allow the player-piano to be actuated by an electrical input from control 150, the control apparatus of the present invention is placed, as described above, intermediate the multiplicity of tubes 28, with each tube 28 having the side adjacent tracker bar 12 connected to outlet 106 and the side adjacent to valve 22 connected to inlet 104. As discussed above, inlet 104 and, therefore, the inlet side 110 of passageway 108, is connected to the reduced pressure within vacuum chest 24. This reduced pressure, acting through vents 128, holds plunger 130 of solenoid 132 tightly against surface 120, thus sealing the vent hole 129. Likewise, the reduced pressure downwardly deforms resilient covering 121 so that hole 114' is covered and, therefore, sealed. If it is desired to actuate the player-piano via the piano-paper roll and tracker bar system, duct 124 would then be connected to the suction bellows of the piano (not shown) which, due to leakage throughout the system, is at a reduced pressure when compared to the pressure in inlet side 110, which, therefore, causes resilient cover 121 to move out of sealing engagement with opening 114' therefore connecting the inlet and outlet sides 110, 112, respectively, of passageway 108. This allows the player-piano to be actuated in the standard fasion, as described above.

When it is desired to electrically actuate the piano, atmospheric pressure is introduced into line 124, allowing resilient covering 121 again to isolate the inlet side 110 from the outlet side 112 of passageway 108. The piano may now be actuated via the selective energization of solenoids 132, which energization causes plungers 130 to be moved upwardly out of sealing engagement with vents 128, causing atmospheric air to flow through vent 128, into inlet side 110, through tube 28 and into duct 36. This, in turn, causes the actuation of the piano action, as described hereinabove. A well-known microprocessor control 150 based on the MIDI system can interface with and be used to control and actuate selected ones of the solenoids 132 to thereby play any pre-programmed song on the piano or, in fact, can be actuated remotely in real time, by playing on a remote electronic keyboard.

The present invention may also be used in modified, new or existing non-player pianos (i.e., with no tracker bar). A pneumatic stack is installed in this piano to use vacuum or air pressure as a motive force for actuating the keys. In this situation, the series of depressions 118 and corresponding bores 114, 116 can be eliminated since there is no need to isolate the tracker bar assembly. The system may then be operated exclusively by the opening and closing of outlet 38 by solenoids 132.

Figure 6:
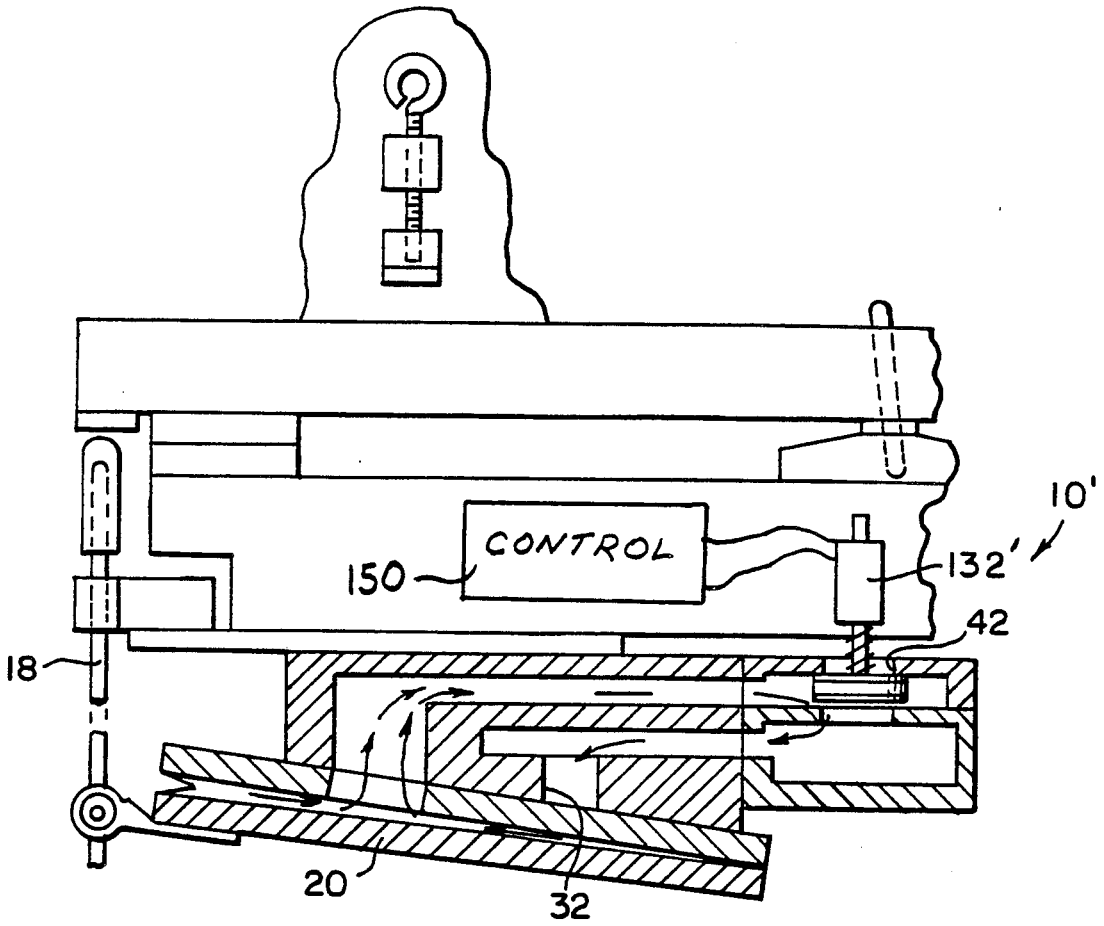
FIG. 6 is a side view of an alternate embodiment of the control apparatus of the present invention.

Alternately, as shown in FIG. 6, solenoid valve 132' may be directly connected to each valve 10' of the pneumatic stack to thereby either vent the vacuum side of the valve to atmosphere or to cover opening 42 and connect the pneumatic to vacuum chest 24 via passageway 32. Valve 10', of course, has no pouch 48, or passageway 36 or outlet 38, since control system 150 directly controls the solenoid valve 132 by the connection of pneumatic 20 to vacuum or atmosphere. This design would, of course, eliminate control apparatus 100.

In addition, a system could be designed where, prior to actuation, the air inside bellows 20 is at atmospheric pressure, with the bellows spring loaded in a collapsed state, and then the actuating force is provided by air at higher than atmospheric pressure. The introduction of this high pressure air would be controlled by the solenoid valve 132. The bellows would then be collapsed by the spring after expansion by the venting of the high pressure air.

While several embodiments and examples of the present invention have been illustrated and described, it is obvious that many changes and modifications may be made thereunto, without departing from the spirit and scope of the invention.

What is claimed is:

1. An apparatus for controlling a mechanical music-maker of the type using a vacuum as the motive force for driving a multiplicity of mechanical actuators, each mechanically actuating a corresponding musical key, the music-maker includes a multiplicity of valves for connecting the vacuum to the multiplicity of mechanical actuators when opened, the valves being held closed by a vacuum applied to a vacuum side thereof and opened upon having the vacuum side thereof vented to atmosphere, the music-maker including a first means for opening the valves by coupling the vacuum side of selected valves to atmosphere, the apparatus further comprising:

second means for opening the valves by coupling the vacuum side of selected valves to atmosphere;

said second means including an electrically energizable solenoid valve directly connected to said vacuum side of each of said valve means and venting said vacuum side to atmosphere upon energization of the solenoid thereof; and selector means for selectively isolating said first means from the valves so that opening selected valves by coupling the vacuum side of each selected valve to atmosphere is accomplished solely by said second means.

2. The apparatus for controlling a mechanical music-maker, as set forth in claim 1, wherein the first means includes a tracker bar having a registry member with a series of passages for registering with holes in a paper player-piano roll, all of said passages in said tracker bar connected by said selector means to the vacuum side of each of the valves and venting the vacuum side to atmosphere when a hole in said paper player-piano roll registers with a passage in said tracker bar.

3. The apparatus for controlling a mechanical music-maker, as set forth in claim 1, wherein said selector means comprises:

a valve body having a multiplicity of passageways therein, each corresponding to a musical key on the mechanical music-maker;

an inlet side of each of said passageways being coupled to the vacuum side of each valve means;

an outlet side of each of said passageways coupled to said first means;

an isolation means in each of said passageways for isolating said outlet side and therefore said first means from said inlet side of said valve body;

a vent extending from each of said multiplicity of passageways to the atmosphere between an inlet on said inlet side and said isolation means; and, a solenoid operated valve for sealing each vent when de-energized.

4. The apparatus for controlling a mechanical music-maker, as set forth in claim 3, wherein said isolation means includes a multiplicity of depressions formed on a surface of said valve body intermediate each passageway and each covered by a resilient, air-tight covering, each depression having a first centrally located opening connected to said inlet side of a passageway and a second opening, located at the perimeter thereof, connected to said outlet side of said passageway so that upon application of a vacuum to the inlet side, said resilient covering is sucked downwardly into said depression and covers said central opening to isolate said inlet side of said passageway from said outlet side and, therefore, said first means; and, means for lifting said covering off said central opening to connect the inlet side of the passageway to the outlet side thereof and, therefore, said first means to said valve means.

5. The apparatus for controlling a mechanical music-maker, as set forth in claim 4, wherein said means for lifting said covering off of said central opening is a vacuum chamber formed above and surrounding said multiplicity of depressions for pulling said covering away from said central opening upon creation of a differential pressure between said chamber and said inlet side of each of said passageways.

6. A method for controlling a mechanical music-maker of the type using a vacuum as a motive force for driving a multiplicity of mechanical actuators for actuating corresponding musical keys, wherein the mechanical actuators are each controlled by a valve held closed by the vacuum, which valve connects the vacuum to the mechanical actuator when opened, the valve being opened when a vacuum side thereof is vented to atmosphere, said method comprising the steps of:

directly connecting an electrically actuatable venting means to the vacuum side of each valve, said venting means coupled to atmosphere when actuated; and, actuating selected ones of said venting means in response to an electrical input signal to control the actuation of corresponding musical keys of the mechanical music-maker.

7. An apparatus for controlling a mechanical music-maker of the type having a plurality of mechanically actuated musical keys, comprising:

a multiplicity of pneumatically driven mechanical actuators, each mechanically actuating a corresponding musical key;

a multiplicity of valves for selectively connecting said multiplicity of mechanical actuators to a source of pneumatic power when opened and isolating said mechanical actuators from said source of pneumatic power when closed;

means for holding said valves in a normally closed position;

a solenoid directly connected to each of said multiplicity of valves for opening said valves; and, control means for selectively energizing said solenoid valves to thereby open said valve and actuate corresponding mechanical actuators.

* * * * *